United States Patent [19]

Meyers

[11] Patent Number: 4,953,737

[45] Date of Patent: Sep. 4, 1990

[54] SELF-RIGHTING VESSEL

[75] Inventor: Kenneth A. Meyers, Reedsburg, Wis.

[73] Assignee: Gerber Products Company, Fremont, Mich.

[21] Appl. No.: 3,460

[22] Filed: Jan. 28, 1987

[51] Int. Cl.[5] ..... A47G 19/22

[52] U.S. Cl. ..... 250/70; 215/1 R; 220/69; 220/90.4

[58] Field of Search ..... 220/69, 70, 90.2, 90.4, 220/90.6

[56] References Cited

U.S. PATENT DOCUMENTS

| | | |
|---|---|---|
| D. 155,304 | 9/1949 | McKay . |
| D. 216,730 | 3/1970 | Carslaw . |
| D. 233,972 | 12/1974 | Jublin . |
| 2,550,568 | 4/1951 | Kersh . |
| 2,601,767 | 4/1946 | Wall . |
| 3,549,044 | 12/1970 | Lerner . |
| 3,966,077 | 6/1976 | Jardine . |
| 4,096,966 | 6/1978 | Korshak . |
| 4,121,731 | 10/1978 | Okerstrum . |
| 4,303,170 | 12/1981 | Panicci . |
| 4,388,996 | 6/1983 | Panicci . |

FOREIGN PATENT DOCUMENTS

| | | |
|---|---|---|
| 1164969 | 9/1969 | United Kingdom . |
| 1229426 | 4/1971 | United Kingdom . |

*Primary Examiner*—George E. Lowrance

*Attorney, Agent, or Firm*—Price, Heneveld, Cooper, DeWitt & Litton

[57] ABSTRACT

A vessel which is self-righting and stable without the need for a weighted base is comprised of a planar base and sides whose cross section is an arc of an involute defined by a circle inside the cup. The most extended point on the involute is at or adjacent to the rim of the cup while the least extended point is the point where the side joins the planar base. In preferred embodiments, the vessel includes both a cup portion and a lid which retains liquids in the cup portion such that the overall center of gravity remains on the side of the reaction force vector at the point of contact between the cup and the surface on which it is placed, toward the center of the vessel.

13 Claims, 3 Drawing Sheets

SELF-RIGHTING VESSEL

BACKGROUND AND SUMMARY OF THE INVENTION

The present invention relates to drinking vessels for holding liquids, with particular applicability to drinking cups.

In certain environments, drinking cups are very likely to tip over causing spillage of their contents. Such environments extend to adult usage, such as inside moving vehicles, as well to child or infant usage, such as on the tray of a high chair or children's dining tables in general. As a result, various designs for self-righting cups, i.e., cups which will return to their upright position when tilted, have been developed.

A common way of achieving this effect is to provide ballast in the base of the cup. This has also been combined with providing the cup with a rounded bottom. Such structures are generally unsatisfactory, however, since the angle through which the cups can be tilted and then returned to the upright position is fairly limited, and round-bottom vessels tend to rock at the slightest jostling.

The present invention provides a self-righting vessel of unusual stability, which neither rocks nor relies on a weighted base. The self-righting capability is imparted to the vessel by the shape of the vessel sides, whose vertical cross section is an involute defined by a hypothetical circle located inside the cup.

The term "involute" is used here in accordance with its common accepted definition, i.e., a curve traced by a point of a perfectly flexible inextensible thread kept taught as it is wound upon or unwound from another curve (in this case, a circle). The involute thus spirals in towards the circle, although as used herein it is truncated prior to meeting the circle. The most extended portion of the involute is at or in proximity to the rim at the mouth of the vessel, while the least extended point is at or adjacent to the bottom of the vessel. The bottom of the vessel connecting the sides is recessed forming a ring which rests flat on a table surface.

In various embodiments of the invention, the cup itself is a body of revolution about a vertical centerline, and the various circles defining the involutes of the sides have a common center located on the centerline, and revolve around the centerline to form a hypothetical sphere. The circles and sphere are of course imaginary and are referred to herein only for purposes of establishing the shape and location of the involutes forming the profiles of the sides of the vessel. They are not part of the actual structure of the vessel.

Also in various embodiments of the invention, the center of gravity of the vessel once it is tilted away from the upright position is offset from the reaction force vector resulting from contact of the vessel with the surface on which it is resting. As will be seen from the description which follows, tilting the vessel to shift the contact point from the bottom to one of the involutes shifts the reaction force vector to a position tangent to the circle defining the involute. Placing the center of gravity of the cup inside or below the circle assures that the offset mentioned above will be maintained until the cup rights itself. The offset will always be in a direction which urges the cup back to its upright position.

In further preferred embodiments the ratio of the cup diameter at the most extended point on the involute to the diameter of the circle defining the involute is from about 2.0 to about 7.0 with about 3.0 to about 4.0 preferred. Further dimensions are preferred as placing the center of gravity of the cup inside the involute circle and above the center of the circle. In still further preferred embodiments, the cup includes a removable lid or cover, containing a spout and a vent hole. When in place, the lid further assures that the liquids inside the vessel will remain in a location whereby the overall center of gravity (including the vessel, lid and liquid contents) at any angle of tilt will be offset from the reaction force vector at the contact point in the direction tending to urge the vessel back to its upright position.

Further embodiments of the invention will be apparent from the description which follows.

DETAILED DESCRIPTION OF THE INVENTION AND PREFERRED EMBODIMENTS

Figure 1:
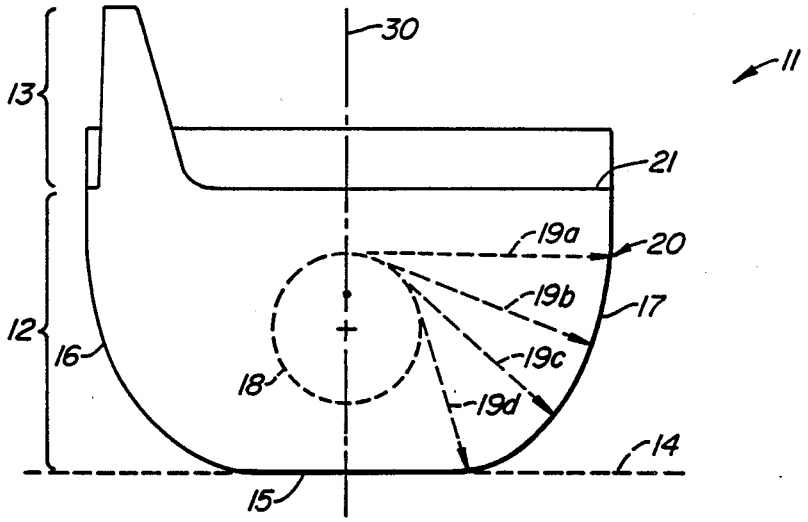
FIG. 1 is an outline of a self-righting vessel in accordance with the present invention shown in the upright position with the circle defining the involute side walls shown in dashed lines.

FIG. 1 illustrates the arrangement of involute sides in an illustrative embodiment of the invention as well as the manner in which the involutes are generated.

The vessel 11 is comprised of a cup portion 12 and lid 13, the cup portion resting upright on a flat surface 14 (shown in dashed lines.) The cup portion has a base 15 and sides 16, 17. As shown in profile in this figure, the sides appear as two opposing curves, both involutes defined by a central imaginary circle 18 (shown in dashed lines). In this embodiment and preferred embodiments in general, the opposing sides are mirror images of each other. The base is a planar contacting area such as a flat surface or a ring which prevents the vessel from rocking when upright. A ring formed by a recess in the base is a particularly convenient configuration.

The formation of the involute forming the right side 17 is demonstrated by the tangent lines 19*a–d* which represent the imaginary thread being wound around the circle 18, a fixed point 20 on the thread tracing the shape of the involute as the thread is wound. The point of the involute at greatest extension, and hence the location of point 20 of the thread at its least wound is approximately directly below the rim 21 of the cup, indicated by line 19*a*. The point corresponding to the least extension of the involute is indicated by line 19*d* and is at the point where the cup side 17 joins the flat base 15.

It will be noted that the involute is incomplete, the curve terminating short of the point where the fixed point 20 on the imaginary thread reaches the circle 18 and beginning at a point where the thread is tangential to the circle (tangent line 19*a*). It is also preferred that the flat base 15 of the cup extend in both directions beyond the diameter of the circle 18. The tangent line 19*d* at the termination of the involute is thus at an acute angle with respect to the vertical.

Figure 2:
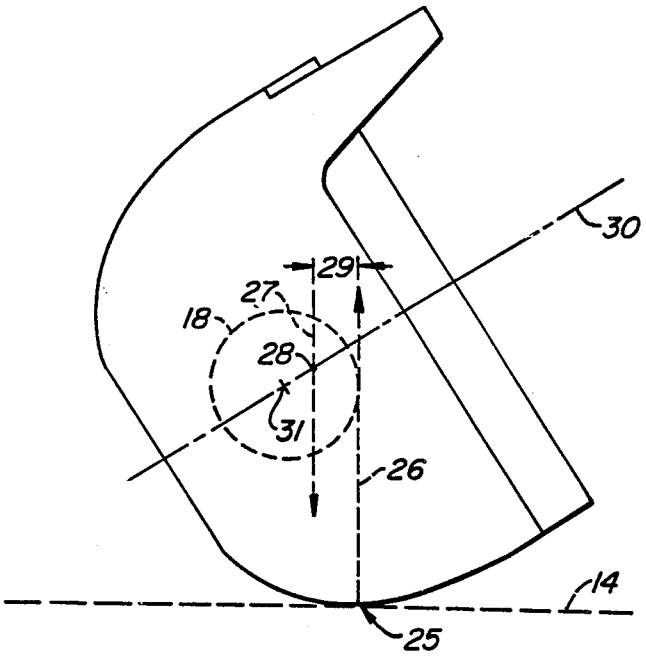
FIG. 2 is an outline of the vessel shown in FIG. 1 although in tilted position, showing the circle, reaction force vector and gravitational force vector in dashed lines.

FIG. 2 demonstrates the vessel of FIG. 1 in a tilted position such that the contact point 25 is on one of the involutes. The contact point is the point of contact between the outer surface of the vessel and the supporting surface 14 (table top, for example) on which the vessel has been placed. A characteristic of a vessel having involutes for sides is that the reaction force vector 26, which is the counterforce exerted by the support surface 14 on the vessel in response to the gravitational force of the vessel, runs tangent to the circle 18. For an empty vessel, the gravitational force vector 27 passes through the center of gravity 27 of the structure. The self-righting character of the vessel is derived from the lateral displacement or offset 29 between the two vectors, resulting in a torque tending to rotate the vessel back to its upright position. For a vessel containing a liquid, the gravitational force vector will be located a short distance to the right of the vector 27 shown in the figure, and will be lower, but will still be offset from the reaction force vector 26 in the same direction. Thus, the gravitational force vector 27 will always be on the side of the reaction force vector 26 in the direction in which rotation is desired.

In preferred embodiments such as that shown, the center of gravity 28 of the vessel when empty is located inside the circle 18. This assures the offset of the vectors when the sole contact point for the empty vessel is on the involute. The reverse situation will occur when the vessel is tilted in the other direction. In particularly preferred embodiments, the center of gravity for the empty vessel is on the centerline 30 between the center 31 of the circle and the top of the circle (when the vessel is upright).

In further preferred embodiments, the cup is a body of revolution around the central axis 30, the involutes forming a continuous side wall. The dimensions may vary. In general, the ratio of the largest outer diameter of the side walls (i.e., at the most extended points of the involutes) to the diameter of the circle 18 from which the involutes are generated will range from about 2.0 to about 7.0. preferably from about 3.0 to about 4.0. A ratio of approximately 3.6 has been found to be particularly effective for a child's drinking cup. The ratio of the outer cup diameter formed by the involutes at their greatest extension to the height of the cup is preferably within the range of about 1.0 to about 2.0.

Figure 3:
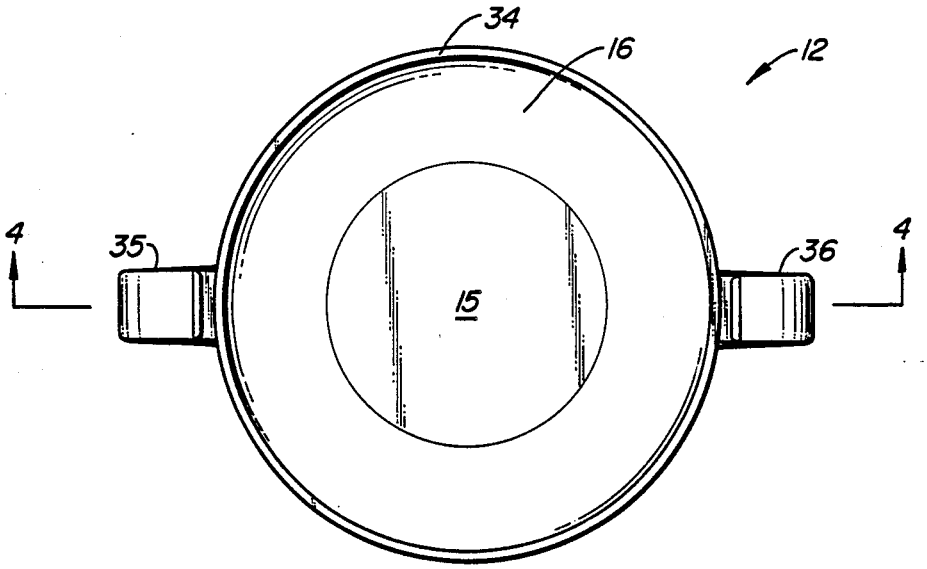
FIG. 3 is a top view of a cup in accordance with a second embodiment of the present invention.

FIG. 3 is a top view of the cup portion 12 of a second embodiment of a vessel illustrative of the present invention. Here, as in other preferred embodiments, the cup portion is a body of revolution, forming a circular flat base 15 and a circular side 16. The open top of the cup terminates in a circular rim 34. Also included on this cup are handles 35, 36.

Figure 4:
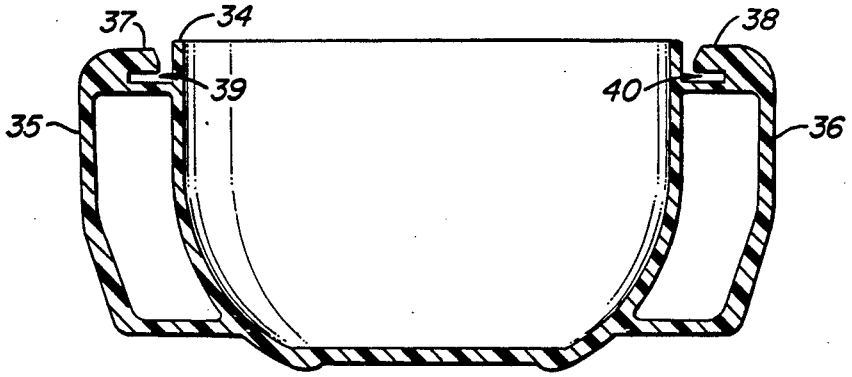
FIG. 4 is a cutaway view of the cup of FIG. 3 taken along lines 4—4 thereof.

The handles are also seen in the cross section view of FIG. 4. The upper ends of each handle are turned in to form hooks 37, 38 which, as will be seen below, secure a lid over the cup 12. The hooks define recesses 39, 40 for receiving tabs extending laterally from the lid.

Figure 5:
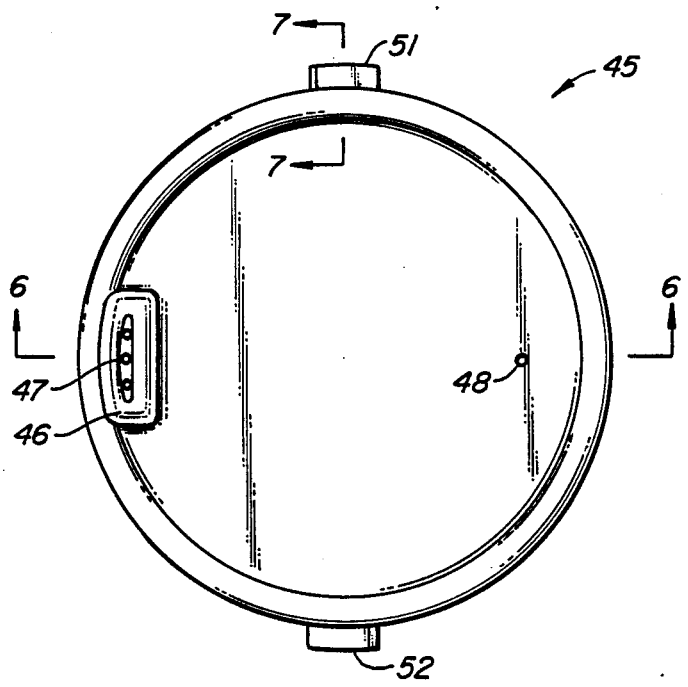
FIG. 5 is a top view of a lid designed to fit over the cup of FIG. 3.
Figure 6:
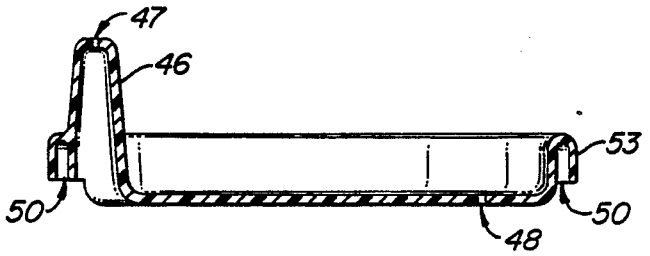
FIG. 6 is a cutaway view of the lid of FIG. 5 taken along lines 6—6 thereof.

The lid itself 45 may be seen in FIG. 5. The purpose of the lid is to permit a child or other user to drink liquids from the vessel while minimizing the risk of spillage. This spout is similar in shape to the spout (unnumbered) shown in the embodiment of FIGS. 1 and 2 extending upward from the vessel itself. Accordingly, a spout 46 is provided, terminating in a series of holes 47. A hole 48 to permit air entry perforates the lid at the opposing side. These features are seen in profile in the cutaway view of FIG. 6.

Figure 7:
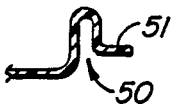
FIG. 7 is a fragmentary cutaway view of a portion of the lid of FIG. 5 taken along lines 7—7 thereof.

Around the periphery of the lid is an inverted groove 50 which fits snugly over the rim 34 of the cup portion (FIG. 4). Tabs 51, 52 extend laterally from the periphery of the lid to fit inside the recesses 39, 40 at the top of each of the handles 35, 36 in the cup portion, thus locking the lid over the cup portion. One such tab 51 is seen in an enlarged view in FIG. 7. The lid is attached therefore by placing it over the cup portion with the tabs 51, 52 offset from the handles 35, 36, pushing the lid down so that the groove 50 snugly engages the rim 34, and rotating the lid so that the tabs 51, 52 are inserted in the recesses 39, 40. To facilitate this rotation, the outer surface 53 of the lid along its periphery may be ribbed for easy manual gripping.

The foregoing is offered primarily for purposes of illustration. It will be readily apparent to those skilled in the art that many of the dimensions, shapes, and structural features disclosed herein may be modified while still remaining within the spirit and scope of the invention.

What is claimed is:

1. A self-righting vessel comprising a planar base and sides each of whose vertical cross section is an involute defined by a circle inside said vessel.

2. A self-righting vessel in accordance with claim 1 in which said vessel has a center axis, and said sides are symmetrical about said center axis.

3. A self-righting vessel in accordance with claim 1 in which said sides form a body of revolution about a vertical centerline passing through said vessel.

4. A self-righting vessel in accordance with claim 3 in which each opposing pair of said involutes in any vertical cross section incorporating said vertical centerline is defined by a common said circle inside said vessel.

5. A self-righting vessel in accordance with claim 4 in which the ratio of the diameter of said vessel at the most extended point of said involute to the diameter of said circle is from about 2.0 to about 7.0.

6. A self-righting vessel in accordance with claim 4 in which the ratio of the diameter of said vessel at the most extended point of said involute to the diameter of said circle is from about 3.0 to about 4.0.

7. A self-righting vessel in accordance with claim 4 in which the ratio of the diameter of said vessel at the most extended point of said involute to the height of said vessel is from about 1.0 to about 2.0.

8. A self-righting vessel in accordance with claim 1 in which said sides form a body of revolution about a vertical centerline passing through said vessel, and the center of said circle is on said centerline.

9. A self-righting vessel in accordance with claim 1 in which the center of gravity of said vessel is inside or below said circle.

10. A self-righting vessel in accordance with claim 1 in which the center of gravity of said vessel is inside said circle above the center thereof when said vessel is upright.

11. A self-righting vessel in accordance with claim 1 in which said sides form a body of revolution about a vertical centerline passing through said vessel; each opposing pair of involutes in any vertical cross section incorporating said vertical centerline is defined by a common circle inside said vessel with center on said vertical centerline; and the center of gravity of said vessel is on said centerline inside said common circle.

12. A self-righting vessel in accordance with claim 1 further comprising a removable cover containing a spout and vent hole.

13. A self-righting vessel in accordance with claim 12 in which said removable cover is attachable to said sides at a height selected such that tipping said vessel from an upright position whereby said vessel contacts a horizontal surface at a contact point on said involute results in offsetting the center of gravity of said vessel and any liquid contained therein from a vertical line passing through said contact point, thereby urging said vessel to roll back along said involute toward said upright position.

* * * * *